US008727815B1

(12) United States Patent
Mongold et al.

(10) Patent No.: US 8,727,815 B1
(45) Date of Patent: May 20, 2014

(54) COMPLIANT PIN CONNECTOR MOUNTING SYSTEM AND METHOD

(71) Applicant: Samtec, Inc., New Albany, IN (US)

(72) Inventors: John Mongold, Middletown, PA (US); Randall Musser, Enola, PA (US)

(73) Assignee: Samtec, Inc., New Albany, IN (US)

( * ) Notice: Subject to any disclaimer, the term of this patent is extended or adjusted under 35 U.S.C. 154(b) by 61 days.

(21) Appl. No.: 13/688,400

(22) Filed: Nov. 29, 2012

(51) Int. Cl.
*H01R 13/42* (2006.01)

(52) U.S. Cl.
USPC ..... 439/751; 439/943

(58) Field of Classification Search
USPC ..... 439/751, 82, 873, 943
See application file for complete search history.

(56) References Cited

U.S. PATENT DOCUMENTS

| | | | | |
|---|---|---|---|---|
| 4,904,212 | A * | 2/1990 | Durbin et al. | 439/751 |
| 5,411,418 | A * | 5/1995 | Welsh et al. | 439/751 |
| 2005/0003687 | A1 | 1/2005 | Ikeda et al. | |
| 2005/0277312 | A1 | 12/2005 | Nakamura | |
| 2007/0010139 | A1 | 1/2007 | Chen | |
| 2008/0182438 | A1 | 7/2008 | Fedder et al. | |
| 2009/0035964 | A1 | 2/2009 | Yamamoto et al. | |

FOREIGN PATENT DOCUMENTS

KR 10-2008-0016959 A 2/2008

OTHER PUBLICATIONS

Official Communication issued in corresponding International Patent Application PCT/US2013/056335, mailed on Dec. 10, 2013.

* cited by examiner

*Primary Examiner* — Neil Abrams
*Assistant Examiner* — Phuongchi T Nguyen
(74) *Attorney, Agent, or Firm* — Keating & Bennett, LLP

(57) ABSTRACT

A compliant pin connector mounting system includes a connector housing, a plurality of contacts each disposed in the connector housing and each including a compliant portion and at least one load bearing surface, and a mounting tool arranged to fit into the connector housing and to contact the at least one load bearing surface of each of the plurality of contacts so as to apply a downward force directly to each of the plurality of contacts. The compliant portion of each of the plurality of contacts is arranged to be aligned with a respective hole in a substrate such that when the downward force is applied directly to the at least one load bearing surface of each of plurality of contacts by the mounting tool, the compliant portion of each of the plurality of contacts is press fit into the respective hole in the substrate.

14 Claims, 7 Drawing Sheets

COMPLIANT PIN CONNECTOR MOUNTING SYSTEM AND METHOD

BACKGROUND OF THE INVENTION

1. Field of the Invention

The present invention relates to a compliant pin connector mounting system and a method of mounting a compliant pin connector on a substrate.

2. Description of the Related Art

Connectors have conventionally been mounted to circuit boards via solder. An alternative way of mounting connectors to a substrate is via solderless contacts. However, conventional solderless contacts have suffered from various problems.

Particularly, stresses are applied to the solderless contacts of the connector during mounting of the connector to a circuit board, and additional stresses caused by thermal expansion are applied to the solderless contacts of the connector during operation. These stresses may cause damage to the solderless contacts and reduce the reliability of the connector.

In addition, due to manufacturing tolerances, the contacts of the connector may not be properly aligned with the respective mounting structure on the circuit board. Such misalignment may make it difficult to mount the connector on the circuit board, may prevent proper electrical connections between the contacts of the connector and the mounting structure on the circuit board, and may cause damage to the contacts of the connector during mounting to the circuit board, such as buckling of the contact.

To prevent some of the problems described above, a variety of compliant pin configurations have been used in order to provide a structure that can compensate for the stresses applied to the contacts during mounting of the connector to the circuit board and to compensate for the additional stresses caused by thermal expansion during operation, so as to prevent damage to the solderless contacts. However, conventional solderless contacts with compliant pin configurations have a relatively large length, which are prone to buckling during mounting of the connector to a circuit board.

Further, conventional compliant pin connectors having small contact pitches and fine geometries are typically insert molded components, in which plastic is molded around the contacts, which prevents movement of the contact retention portion and facilitates mounting of the connector to a circuit board. However, insert molded components are very expensive to produce.

In addition, various tools and mounting methods have been used to attempt to overcome the problems described above. For example, for a connector having a very simple geometry (particular face geometry), a block having a flat surface, known as a "Flat Rock," has been used to apply a downward force to a face of the connector in order mount the connector to a circuit board. However, such a simple block is unsuitable for mounting connectors having more complicated geometries. Further, a mounting method has been used in which separate loads are applied to each individual solderless contact. However, such a method is very time consuming and costly. Thus, none of the known tools or mounting methods have been able to adequately cope with and overcome the problems described above.

SUMMARY OF THE INVENTION

To overcome the problems described above, preferred embodiments of the present invention provide a compliant-pin-connector mounting tool and method of mounting, all of which provides a reliable solderless mounting of a connector, reduces stress arising from thermal loading, and increases positional tolerance of the connector.

A compliant pin connector mounting system according to a preferred embodiment of the present invention includes a connector housing, a plurality of contacts each disposed in the connector housing and each including a compliant portion and at least one load bearing surface, and a mounting tool arranged to fit into the connector housing and to contact the at least one load bearing surface of each of the plurality of contacts so as to apply a downward force directly to each of the plurality of contacts. The compliant portion of each of the plurality of contacts is arranged to be aligned with a respective hole in a substrate such that when the downward force is applied directly to the at least one load bearing surface of each of plurality of contacts by the mounting tool, the compliant portion of each of the plurality of contacts is press fit into the respective hole in the substrate.

The compliant portion of each of the plurality of contacts preferably includes a hole extending therethrough. Each of the plurality of contacts preferably further includes an intermediate portion extending from the compliant portion and a beam portion extending from the intermediate portion, and the at least one load bearing surface is defined by an upper surface of the intermediate portion. The at least one load bearing surface of each of the plurality of contacts preferably includes two load bearing surfaces disposed on opposite sides of the beam portion. A thickness of the intermediate portion is preferably about 33% greater than a thickness of the beam portion.

The mounting tool preferably includes a main body portion and an engagement portion extending from the main body portion, and the engagement portion is preferably configured to fit into the connector housing and to be engaged with the at least one load bearing surface of each of the plurality of contacts.

The plurality of contacts are preferably arranged in a plurality of rows in the connector housing, and the engagement portion preferably includes a plurality of rows extending parallel or substantially parallel to one another and arranged so as to be interdigitated with the plurality of rows of the connector housing. Each of the plurality of rows of the engagement portion preferably includes a bottom wall and recesses each arranged to receive a portion of a respective one of the plurality of contacts. Each of the recesses of the plurality of rows of the engagement portion preferably extends longitudinally from the bottom wall of the engagement portion to the main body portion. Each of the recesses of the plurality of rows of the engagement portion preferably has a width configured to receive a portion of a respective one of the plurality of contacts while portions of the bottom wall are engaged with the at least one load bearing surface of the respective one of the plurality of contacts when the mounting tool is engaged with the connector housing.

A method of mounting a compliant pin connector on a substrate according to another preferred embodiment of the present invention includes the steps of providing a connector housing, providing a plurality of contacts each including a compliant portion and at least one load bearing surface in the connector housing, aligning the compliant portion of each of the plurality of contacts with a respective hole in the substrate, fitting a mounting tool into the connector housing so as to contact the at least one load bearing surface of each of the plurality of contacts, and applying a downward force directly to the at least one load bearing surface of each of the plurality of contacts until the compliant portion of each of the plurality of contacts is press fit into the respective hole in the substrate.

The above and other features, elements, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of the present invention will be described with reference to FIGS. 1-7.

Figure 1:
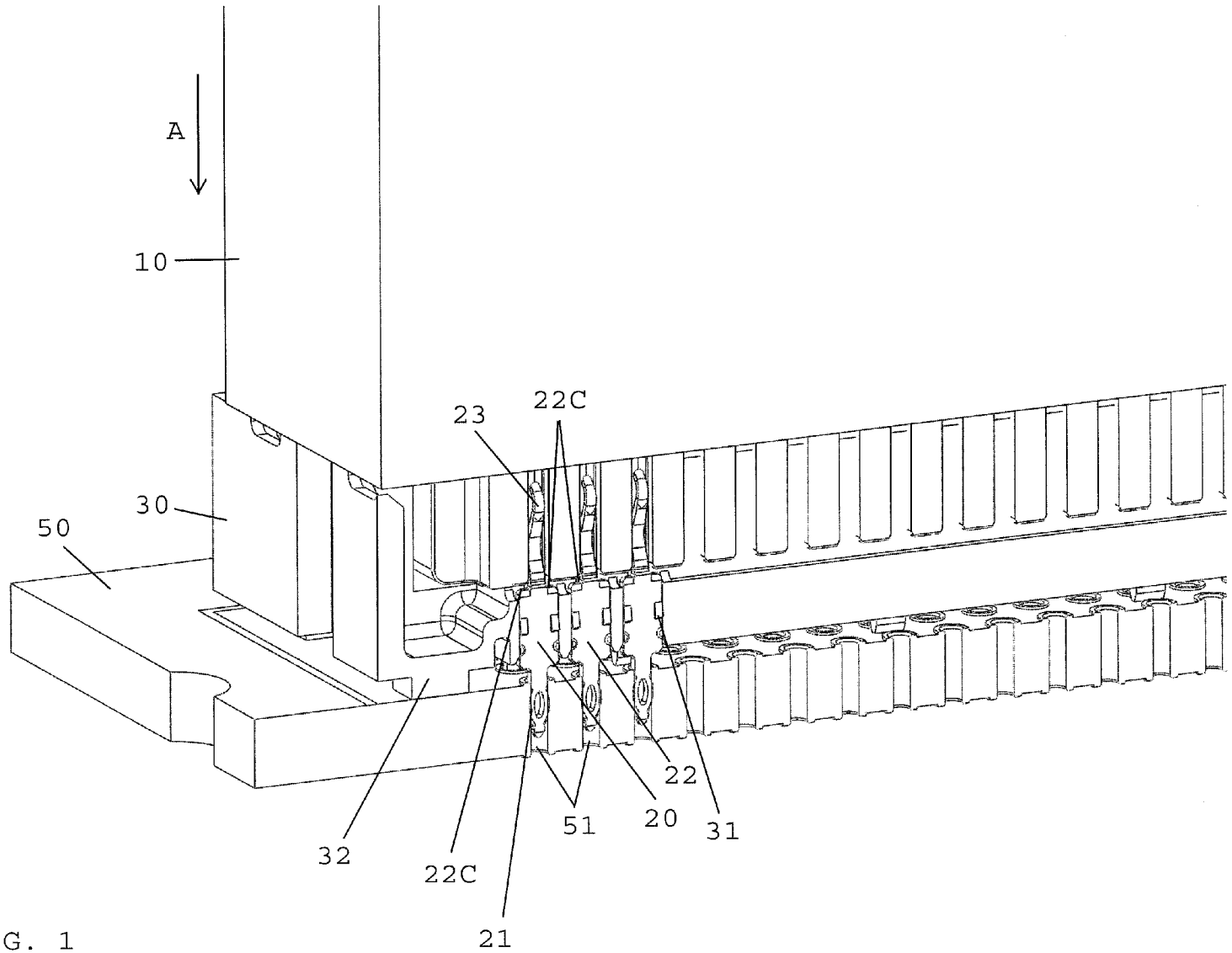
FIG. 1 is a perspective cross-sectional view of a mounting tool that is engaged with a connector housing and contacts disposed in the connector housing according to a first preferred embodiment of the present invention.

FIG. 1 shows a cross-sectional view of a mounting tool 10 that is engaged with a connector housing 30 and contacts 20 disposed in the connector housing 30 according to a first preferred embodiment of the present invention. A downward force in the direction A is applied to the connector housing 30 and the contacts 20 so as to force the compliant portion 21 of each of the contacts 20 into plated through-holes 51 in a substrate 50, thus mounting the connector housing 30 on the substrate 50. The compliant portions 21 of each of the contacts 20 are press fit into the plated through-holes 51 in the substrate 50. Although the mounting tool 10 shown in FIG. 1 is engaged with both the connector housing 30 and the contacts 20, the mounting tool 10 may only be engaged with the contacts 20 and not with the connector housing 30.

Figure 2:
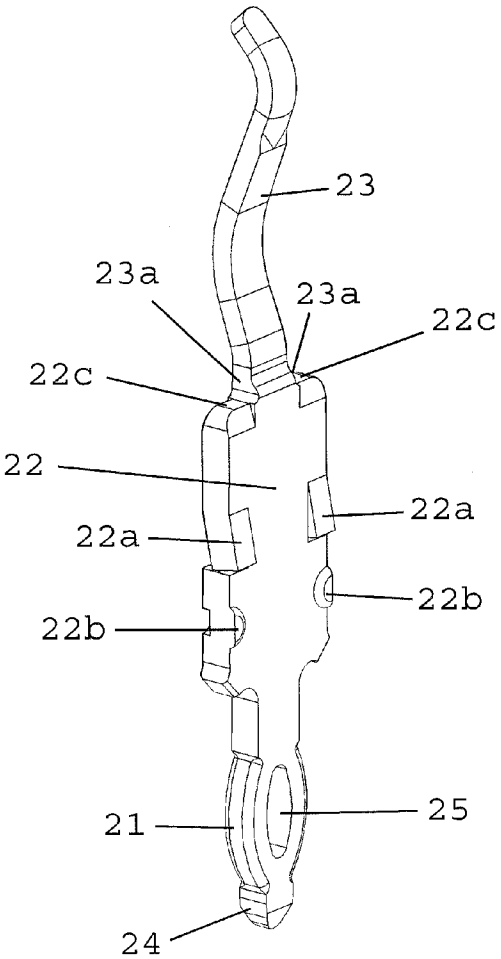
FIG. 2 is a perspective view of the contact shown in FIG. 1.

FIG. 2 shows one of the contacts 20. The contact 20 includes the compliant portion 21, an intermediate portion 22 extending upward from the compliant portion 21, and a beam portion 23 extending upward from the intermediate portion 22. In the present preferred embodiment, the beam portion 23 is preferably flexible and spring-like. The beam portion 23 can include a coined portion in which the thickness of the beam portion 23 is reduced compared to other portions of the beam portion 23, which allows for the sprint rate of the beam portion 23 to be adjusted. The compliant portion 21 includes an end potion 24 having a tapered shape that facilitates insertion of the compliant portion 21 into one of the plated through-holes 51 in the substrate 50 shown in FIG. 1. The compliant portion 21 includes an opening 25 that extends through the compliant portion 21. The opening 25 allows portions of the compliant portion 21 disposed around opening 25 to flex when being inserted into one of the plated through-holes 51 of the substrate 50 so as to provide a tight press fit and so as to compensate for deviations between the positions of the contacts 20 and the positions of the respective plated through-holes 51 in the substrate 50.

As shown in FIG. 2, the intermediate portion 22 of the contact 20 has an increased width and an increased thickness to prevent the contact 20 from buckling when a force is applied to the contacts 20 during mounting of the connector housing 30 on the substrate 50. The thickness of the intermediate portion 22 is preferably about 33% greater than the beam portion 23, for example. However, the intermediate portion 22 may have any suitable thickness as long as buckling of the contact is prevented. The intermediate portion 22 of the contact 20 includes lances 22*a* and dimples 22*b* that extend outward in a thicknesses direction thereof. The lances 22*a* and dimples 22*b* are arranged to securely friction fit the contact 20 in a receiving slot 31 in the connector housing 30 shown in FIG. 1. Although the lances 22*a* and dimples 22*b* are preferably provided in the present preferred embodiment, any suitable structure may be provided as long as the structure provides a secure friction fit in the receiving slot 31.

The intermediate portion 22 further includes upper surfaces 22*c* extending from either side of the beam portion 23. Preferably, each of the upper surfaces 22*c* has a width that is substantially the same as the width of the beam portion 23, such that each of the upper surfaces 22*c* and the beam portion 23 extends across approximately one-third of the width of the intermediate portion 22, for example. The upper surfaces 22*c* are arranged to define load bearing surfaces which are engaged with the mounting tool 10 when the connector housing 30 is mounted on the substrate 50 (see FIG. 1). An upper portion of the intermediate portion 22 is preferably tapered in the thickness direction towards the upper surfaces 22*c* so as to facilitate insertion of the contact 20 into the receiving slot 31 in the connector housing 30 (see FIG. 1). In the present preferred embodiment, the upper surfaces 22*c* are preferably arranged to extend perpendicular or substantially perpendicular to the direction A of the downward force. However, the specific orientation of the upper surfaces 22*c* is not limited to being perpendicular or substantially perpendicular to the direction A of the downward force, and other suitable orientations may be used.

As shown in FIG. 2, the beam portion 23 of the contact 20 has a relatively narrow width and thickness as compared to the intermediate portion 22. The beam portion 23 extends upward from the intermediate portion 22 and is arranged such that the upper surfaces 22*c* of the contact 20 extend from both sides of the beam portion 23. The upper surfaces 22*c* of the intermediate portion 22 are preferably connected to the beam portion 23 via a curved portion 23*a* having a relatively small radius. The beam portion 23 preferably has a curved or serpentine shape that is selected depending upon the application and arrangement of the contact 20, although any suitable shape may be used.

Figure 3:
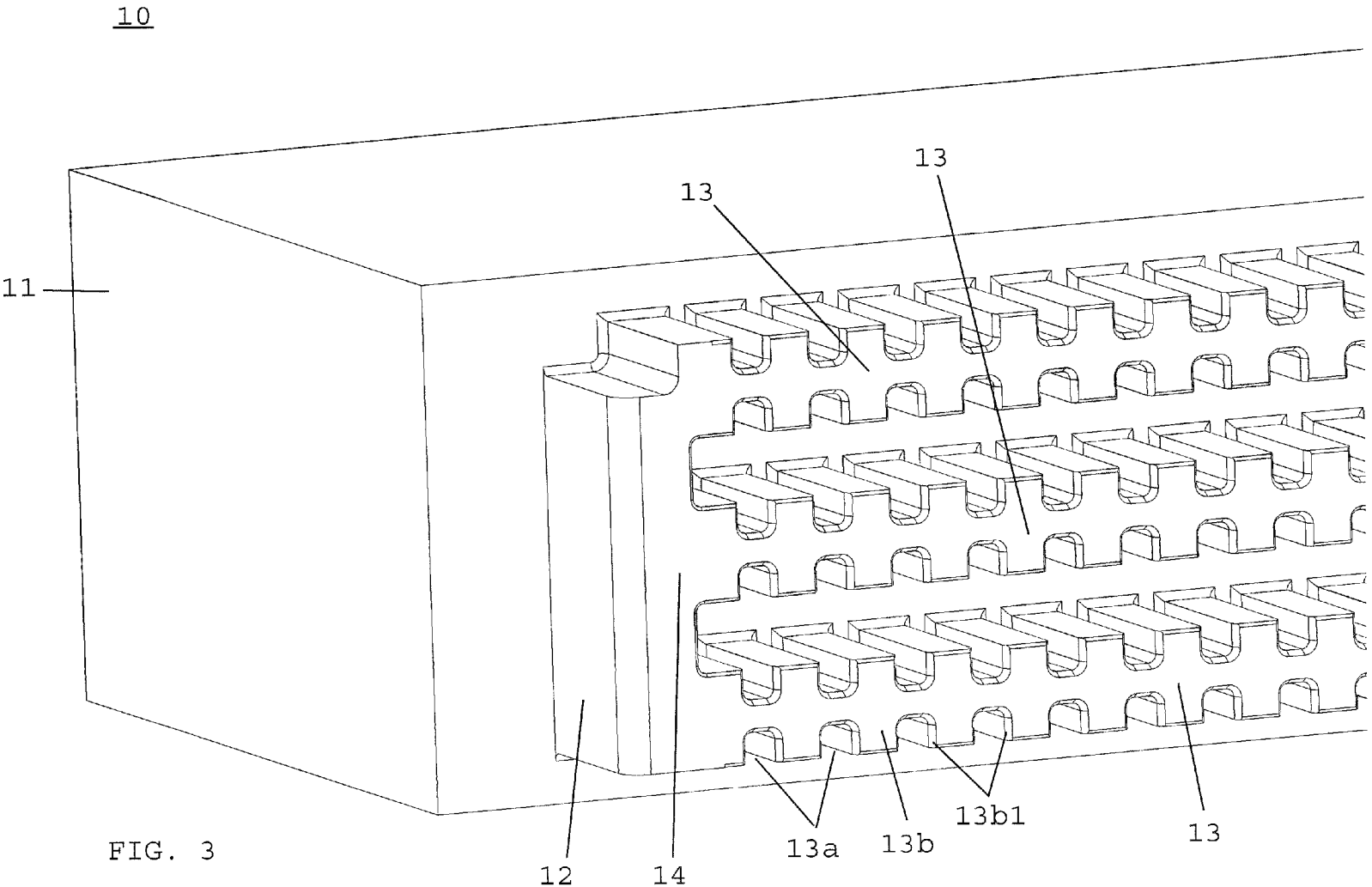
FIG. 3 is an enlarged view of a portion of the mounting tool shown in FIG. 1.

As shown in FIGS. 1 and 3, the mounting tool 10 is configured to engage with the connector housing 30 and with the upper surfaces 22*a* of the intermediate portion 22 of each of the contacts 20. The mounting tool 10 includes a main body portion 11 and an engagement portion 12 extending from the main body portion 11. The engagement portion 12 is configured to fit into the connector housing 30 and to be engaged with the upper surfaces 22*c* of each of the contacts 20. In the present preferred embodiment, the engagement portion 12 includes a plurality of rows 13 that extend parallel or substantially parallel to one another and that are configured so as to be interdigitated with rows of the contacts 20 in the connector housing 30. However, the specific configuration and arrangement of the engagement portion 12 of the mounting tool 10 will be dependent upon the configuration and arrangement of the connector housing with which the mounting tool 10 is being used. The engagement portion 12 of the engagement tool 10 may have any suitable configuration and arrangement as long as the engagement portion 12 fits together with the connector housing 30 and engages with the upper surfaces 22*c* of each of the contacts 20.

In the present preferred embodiment, each of the rows 13 includes recesses 13*a* each arranged to receive the beam portion 23 of one of the contacts 20 and a bottom wall 13*b*. The recesses 13*a* extend longitudinally from a bottom wall 13*b* of the engagement portion 12 towards the main body portion 11. In the present preferred embodiment, the recesses 13*a* extend longitudinally from the bottom wall 13*b* of the engagement portion 12 to the main body portion 11. However, the recesses 13*a* need not extend all the way of the main body portion 11 and may extend towards but not reach the main body portion 11 of the mounting tool 10.

A width of each of the recesses 13*a* is selected so as to provide a clearance for receiving the beam portion 23 of a contact 20 while portions of the bottom wall 13*b* are engaged with the upper surfaces 22*c* of the contact 20 when the mounting tool 10 is engaged with the connector housing 30 and the contacts 20 (see FIG. 1). In the present preferred embodiment, each of the recesses 13*a* has a substantially constant width and includes walls that extend parallel or substantially parallel to each other in the longitudinal direction of the recess 13*a*. However, the shape and arrangement of the recesses 13*a* may have any suitable shape as long as the beam portion 23 of the contact 20 can be received therein and portions of the bottom wall 13*b* can be engaged with the upper surfaces 22*c* of the contact 20.

In the present preferred embodiment, as shown in FIG. 3, the bottom wall 13*b* is preferably provided with tapered portions 13*b*1 that surround each of the recesses 13*a* so as to help guide the beam portion 23 of each of the contacts 20 into respective one of the recesses 13*a*. The tapered portions 13*b*1 prevent scratching or other damage to the contacts 20. However, the bottom wall 13*b* need not necessarily include tapered portions 13*b*1.

In the present preferred embodiment, the engagement portion 12 of the mounting tool 10 includes end portions 14 that extend substantially perpendicular to the rows 13 and are connected to all of the rows 13. However, the end portions 14 are not necessarily required and may be omitted if not required. In addition, the end portions 14 and/or the rows 13 of the mounting tool 10 may include polarization elements which permit the mounting tool 10 to be engaged with the connector housing 30 and the contacts 20 in only one orientation. Furthermore, the polarization elements prevent the wrong mounting tool from being used to mount the connector housing 30 on the substrate 50, which could damage the connector housing 30 and/or the contacts 20. Any suitable type and arrangement of polarization elements may be used.

As shown in FIG. 1, when the mounting tool 10 is engaged with the connector housing 30 and the contacts 20 and a load is applied thereto in order to mount the connector housing 30 on the substrate 50 by forcing the compliant portions 21 of the contacts 20 into the plated through-holes 51 in the substrate 50, the load is directly applied to the upper surfaces 22*c* of the contacts 20. With this configuration, all of the contacts 20 are securely and accurately pressed into the respective plated through-holes 51 in the substrate 50. In order to prevent buckling and/or bending of the compliant portion 21 of the contacts 20, the distance between a lower end of the intermediate portion 22 and the compliant portion 21 is preferably minimized to the greatest extent possible. This length will be determined by the arrangement and configuration of the connector housing 30, the contacts 20, and the substrate 50.

Figure 7:
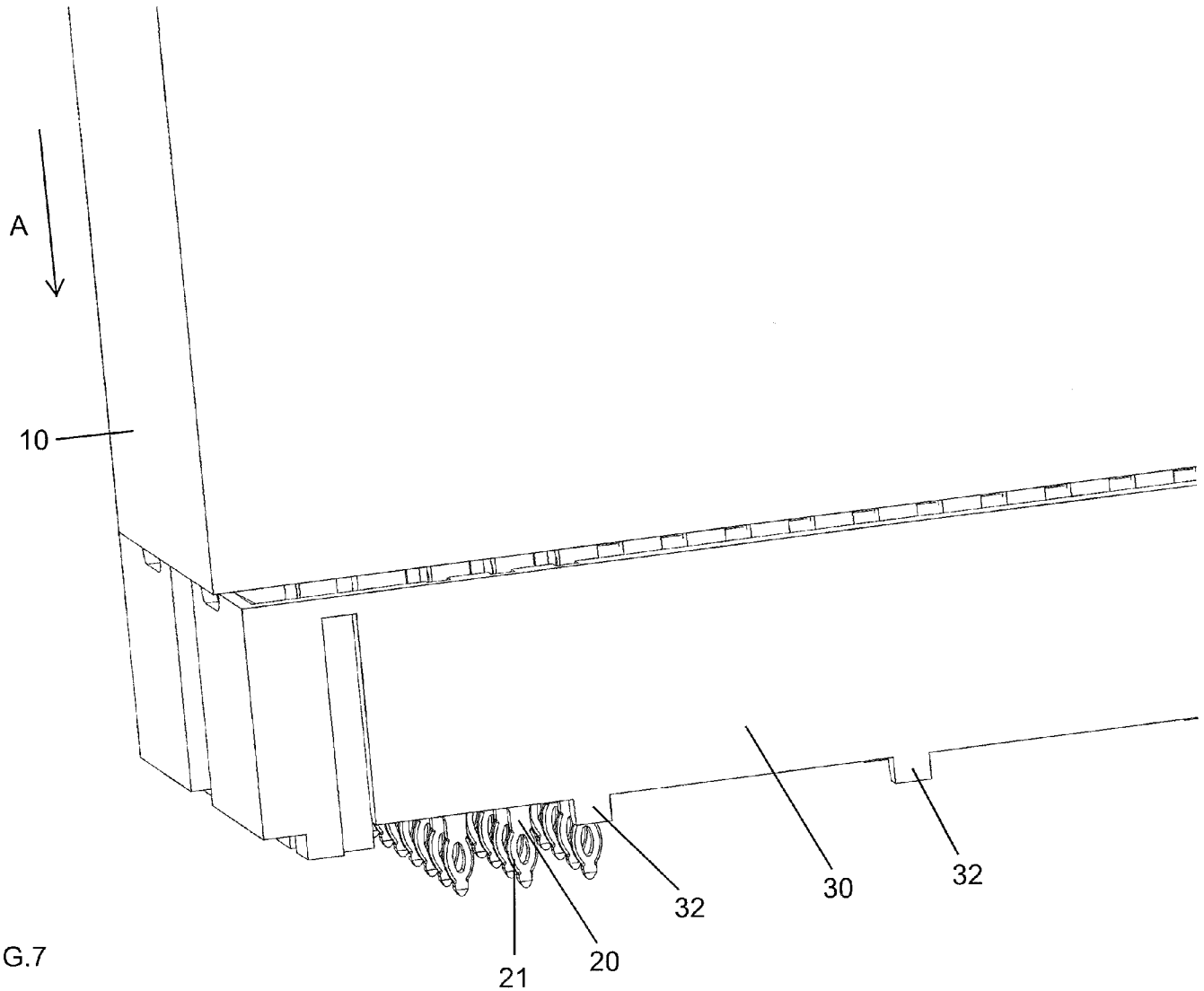
FIG. 7 is an enlarged view of a portion of a connector housing including a standoff projection according to a preferred embodiment of the present invention.

As shown in FIGS. 1 and 7, the connector housing 30 may preferably include a load bearing standoff projection 32 that extends downward from a lower edge of the connector housing 30. The standoff projection 32 is arranged to contact the substrate 50 and prevent over-pressing and/or bowing of the contacts 20 after mounting the connector housing 30 on the substrate 50. Preferably, the standoff projection 32 has a width that is approximately 80% of the width of the contact 20, for example. However, the standoff projection 32 may have any suitable width as long as it prevents over-pressing and/or bowing of the contacts 20 after mounting the connector housing 30 on the substrate 50.

Next a method of mounting the connector housing 30 to the substrate 50 according to a preferred embodiment of the present application will be described with reference to FIG. 1.

As shown in FIG. 1, in order to mount the connector housing 30 on the substrate 50, the ends of the compliant portions 21 of each of the contacts 20 are aligned with the respective plated through-holes 51 in the substrate 50. Then, the mounting tool 10 is fit into the connector housing 30 and portions of the bottom wall 13*b* of the engagement portion 12 surrounding the recesses 13*a* are engaged with the upper surfaces 22*c*. A downward force is applied to the mounting tool 10, and this downward force is transmitted directly to the contacts 20 via the engagement of the portions of the bottom wall 13*b* with the upper surfaces 22*c* of the contacts 20. The application of the downward force causes the compliant portion 21 of the contacts 20 to be pressed into the plated through-holes 51 in the substrate 50 so as to provide a solderless mounting of the contacts 20 of the connector housing 30 to the substrate 50.

The application of the downward force of the mounting tool 10 directly to the contacts 20 enables a reliable solderless mounting of a connector to a substrate 50, reduces stress arising from thermal loading on the connector during use, and increases the positional tolerance of the connector.

Figure 4:
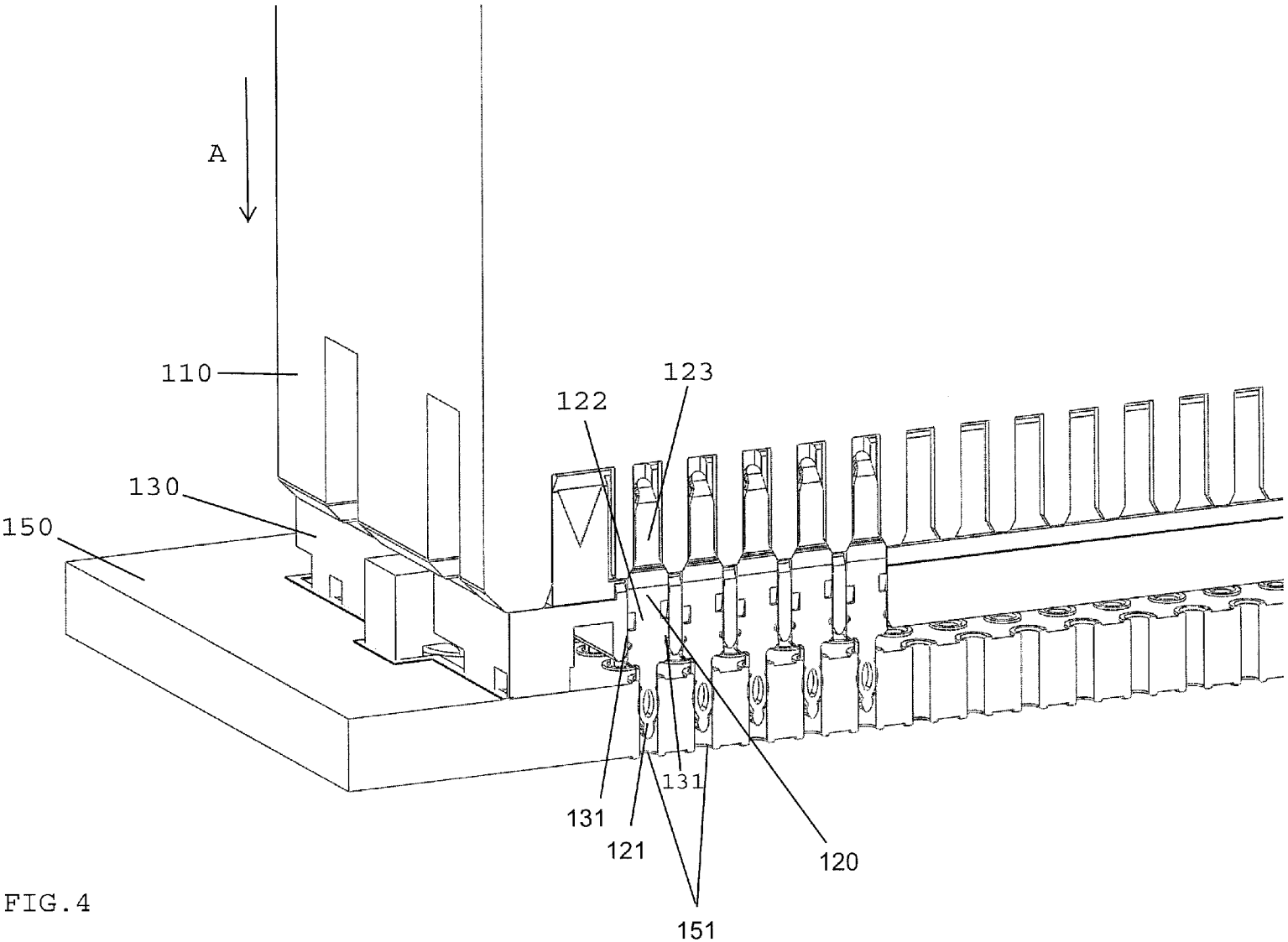
FIG. 4 is a perspective cross-sectional view of a mounting tool that is engaged with a connector housing and contacts disposed in the connector housing according to a second preferred embodiment of the present invention.

FIG. 4 shows a cross-sectional view of a mounting tool 110 that is engaged with a connector housing 130 and contacts 120 disposed in the connector housing 130 according to a second preferred embodiment of the present invention. A downward force in the direction A is applied to the connector housing 130 and the contacts 120 so as to force the compliant portion 121 of each of the contacts 120 into plated through-holes 151 in a substrate 150, thus mounting the connector housing 130 on the substrate 150. The compliant portions 121 of each of the contacts 120 are press fit into the plated through-holes 151 in the substrate 150. Although the mounting tool 110 shown in FIG. 4 is preferably engaged with both the connector housing 130 and the contacts 120, the mounting tool 110 may only be engaged with the contacts 120 and not with the connector housing 130.

Figure 5:
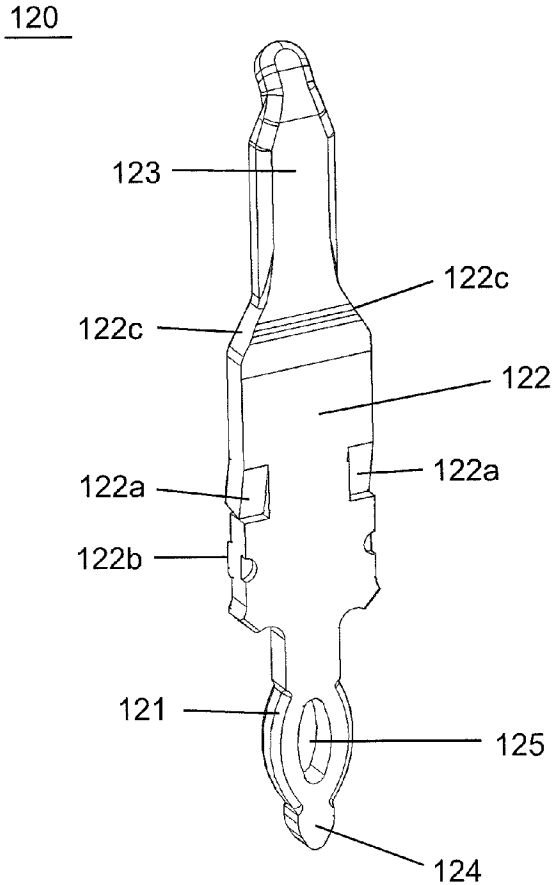
FIG. 5 is a perspective view of the contact shown in FIG. 4.

FIG. 5 shows one of the contacts 120. The contact 120 includes the compliant portion 121, an intermediate portion 122 extending upward from the compliant portion 121, and a beam portion 123 extending upward from the intermediate portion 122. The compliant portion 121 includes an end potion 124 having a tapered shape that facilitates insertion of the compliant portion 121 into one of the plated through-holes 151 in the substrate 150 shown in FIG. 1. The tapered shape of the end portion 124 of the contact 120 of the present preferred embodiment differs from that of the end portion 24 in the first preferred embodiment in that the end portion 124 of the contact 120 in the present preferred embodiment preferably is only tapered along two edges thereof, whereas the end portion 24 of the contact 20 in the first preferred embodiment is tapered along four edges. Any suitable taper may be provided at the end portion 124, or alternatively, the taper may be omitted. The compliant portion 121 includes an opening 125 that extends through the compliant portion 121. The opening 125 allows portions of the compliant portion 121 disposed around the opening 125 to flex when being inserted into one of the plated through-holes 151 of the substrate 150 so as to provide a tight press fit and so as to compensate for deviations between the positions of the contacts 120 and the positions of the respective plated through-holes 151 in the substrate 150.

As shown in FIG. 5, the intermediate portion 122 of the contact 120 has an increased width and an increased thickness to prevent the contact 120 from buckling when a force is applied to the contacts 120 during mounting of the connector housing 130 on the substrate 150. The thickness of the intermediate portion 122 is preferably about 33% greater than the beam portion 123. However, the intermediate portion 122 may have any suitable thickness as long as buckling of the contact is prevented. The intermediate portion 122 of the contact 120 includes lances 122*a* and dimples 122*b* that extend outward in a thicknesses direction thereof. The lances 122*a* and dimples 122*b* are arranged to securely friction fit the contact 120 in a receiving slot 131 in the connector housing 130 shown in FIG. 4. Although the lances 122*a* and dimples 122*b* are preferably provided in the present preferred embodiment, any suitable structure may be provided as long as the structure provides a secure friction fit in the receiving slot 131.

The intermediate portion 122 further includes upper surfaces 122*c* extending from either side of the beam portion 123. Preferably, each of the upper surfaces 122*c* has a width that is substantially the same as the width of the beam portion 123, such that each of the upper surfaces 122*c* and the beam portion 123 extends across approximately one-third of the width of the intermediate portion 22, for example. The upper surfaces 122*c* are arranged to define load bearing surfaces which are engaged with the mounting tool 110 when the connector housing 130 is mounted on the substrate 50 (see FIG. 1). In the present preferred embodiment, unlike the upper surfaces 22*c* in the first preferred embodiment, the upper surfaces 122*c* do not extend perpendicular or substantially perpendicular to the direction A of the downward force and, instead, extend at an angle with respect to the direction A of the downward force. However, the specific orientation of the upper surfaces 122*c* is not limited to any particular angle with respect to the direction A of the downward force, and other suitable orientations may be used. The angles with respect to the direction A of the downward force at which the upper surfaces 122*c* are orientated facilitate insertion of the contacts 20 into the connector housing 130. However, as the angles with respect to the direction A of the downward force increase, less of the downward force is applied to the contacts 20.

As shown in FIG. 5, the beam portion 123 of the contact 120 has a relatively narrow width and thickness as compared to the intermediate portion 122. The beam portion 123 extends upward from the intermediate portion 122 and is arranged such that the upper surfaces 122*c* of the contact 120 extend from both sides of the beam portion 123. The upper surfaces 122*c* of the intermediate portion 122 preferably extend at an acute angle downward from the beam portion 123. The beam portion 123 preferably has a relatively flat shape that is selected depending upon the application and arrangement of the contact 120. However, any suitable shape may be used. As shown in FIG. 5, the beam portion 123 of the contact 120 in this preferred embodiment is relatively flat, except at the upper portion thereof, and the upper portion of the beam portion 123 of the contact 120 is slightly curved or angled.

Figure 6:
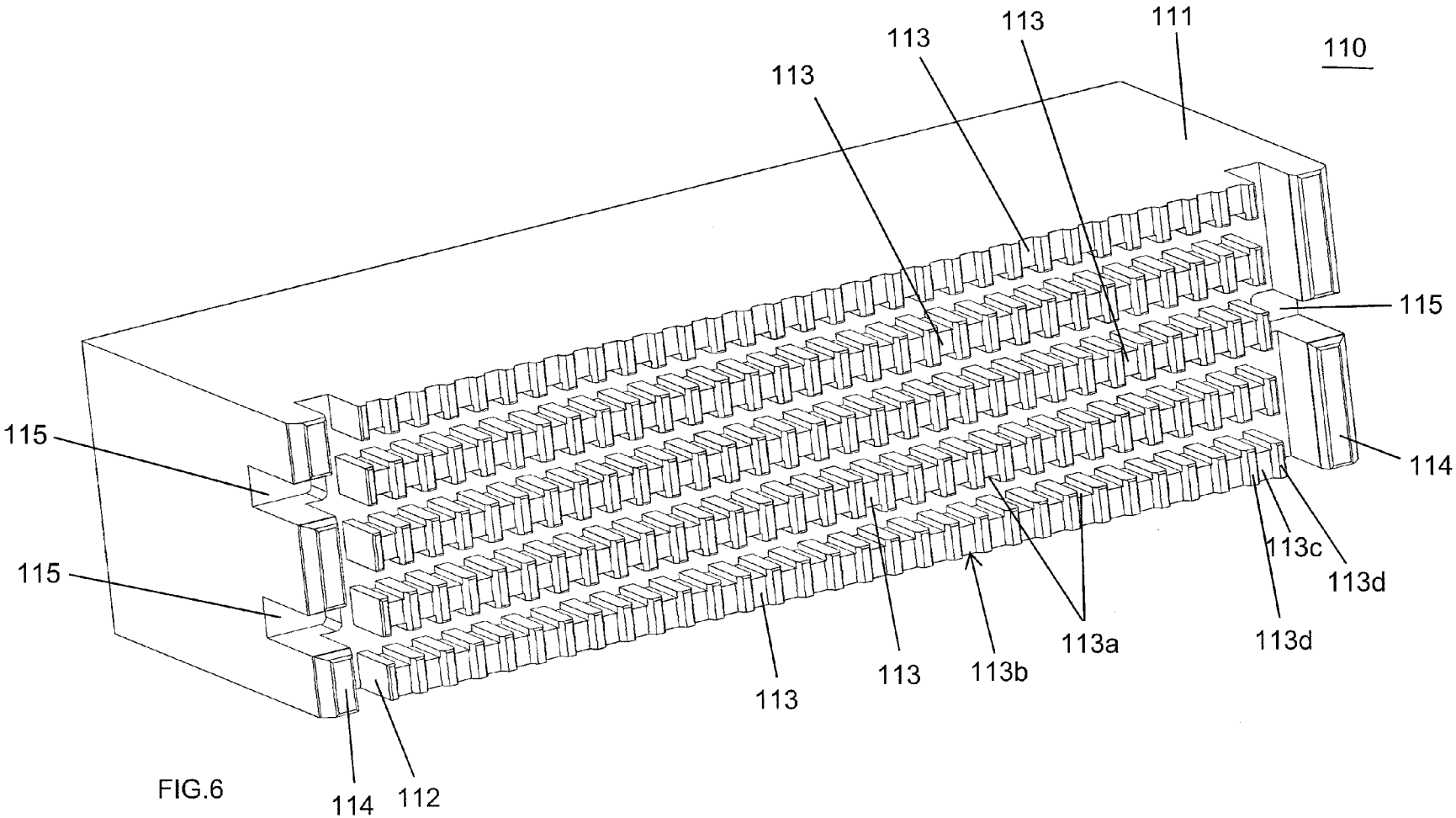
FIG. 6 is an enlarged view of a portion of the mounting tool shown in FIG. 4.

As shown in FIGS. 4 and 6, the mounting tool 110 is configured to engage with the connector housing 130 and with the upper surfaces 122*c* of the intermediate portion 122 of each of the contacts 120. The mounting tool 110 includes a main body portion 111 and an engagement portion 112 extending from the main body portion 111. The engagement portion 112 is configured to fit into the connector housing 130 and to be engaged with the upper surfaces 122*c* of each of the contacts 120. In the present preferred embodiment, the engagement portion 112 includes a plurality of rows 113 that extend parallel or substantially parallel to one another and that are configured so as to be interdigitated with rows of the contacts 120 in the connector housing 130. However, the specific configuration and arrangement of the engagement portion 112 of the mounting tool 110 will be dependent upon the configuration and arrangement of the connector housing 130 with which the mounting tool 110 is being used. The engagement portion 112 of the engagement tool 110 may have any suitable configuration and arrangement as long as the engagement portion 112 fits together with the connector housing 130 and engages with the upper surfaces 122*c* of each of the contacts 120.

In the present preferred embodiment, each of the rows 113 includes recesses 113*a* each arranged to receive the beam portion 123 of one of the contacts 120 and a bottom wall 113*b*. The recesses 113*a* extend longitudinally from a bottom wall 113*b* of the engagement portion 112 towards the main body portion 111. In the present preferred embodiment, the recesses 113*a* extend longitudinally from the bottom wall 113*b* of the engagement portion 112 to the main body portion 111. However, the recesses 113*a* need not extend all the way to the main body portion 111 and may extend towards but not reach the main body portion 111 of the mounting tool 110.

A width of each of the recesses 113*a* is selected so as to receive the beam portion 123 of a contact 120 while portions of the bottom wall 113*b* are engaged with the upper surfaces 122*c* of the contact 120 when the mounting tool 110 is engaged with the connector housing 130 and the contacts 120 (see FIG. 4). In the present preferred embodiment, each of the recesses 113*a* has a substantially constant width and includes walls that extend parallel or substantially parallel to each other in the longitudinal direction of the recess 113*a*. However, the shape and arrangement of the recesses 113*a* may have any suitable shape as long as the beam portion 123 of the contact 120 can be received therein and portions of the bottom wall 113*b* can be engaged with the upper surfaces 122*c* of the contact 120.

In the present preferred embodiment, as shown in FIG. 6, the bottom wall 113*b* also includes a recess 113*c* and two ribs 113*d* disposed on either side of the recess 113*c*. The two ribs 113*d* are arranged so as to be in contact with the upper surfaces 122*c* of respective contacts 120. Furthermore, the ribs 113*d* preferably have tapered sides that are tapered at substantially the same angle at which the upper surfaces 122*c* of the contacts 120 extend. However, the ribs 113*d* may be configured in any suitable manner as long as the ribs 113*d* contact the upper surfaces 122*c* of the contacts 120 when the mounting tool 110 is engaged with the connector housing 130.

In the present preferred embodiment, unlike in the first preferred embodiment, the engagement portion 112 of the mounting tool 110 includes end portions 114 that extend perpendicular or substantially perpendicular to the rows 113 but that are spaced apart from the rows 113 so as not to be connected thereto. However, the end portions 114 are not necessarily required and may be omitted if not required. In addition, in the present preferred embodiment, the end portions 114 of the mounting tool 110 may include polarization elements 115 which permit the mounting tool 110 to be engaged with the connector housing 130 and the contacts 120 in only one orientation. Furthermore, the polarization elements 115 prevent the wrong mounting tool from being used to mount the connector housing 130 on the substrate 150, which could damage the connector housing 130 and/or the contacts 120. Any suitable type and arrangement of polarization elements may be used.

As shown in FIG. 4, when the mounting tool 110 is engaged with the connector housing 130 and the contacts 120 and a load is applied thereto in order to mount the connector housing 130 on the substrate 150 by forcing the compliant portions 121 of the contacts 120 into the plated through-holes 151 in the substrate 150, the load is directly applied to the upper surfaces 122*c* of the contacts 120. With this configuration, all of the contacts 120 are securely and accurately pressed into the respective plated through-holes 151 in the substrate 150. In order to prevent buckling and/or bending of the compliant portion 121 of the contacts 120, the distance between a lower end of the intermediate portion 122 and the compliant portion 121 is preferably minimized to the greatest extent possible. This length will be determined by the arrangement and configuration of the connector housing 130, the contacts 120, and the substrate 150.

Next a method of mounting the connector housing 130 to the substrate 150 according to a preferred embodiment of the present application will be described with reference to FIG. 4.

As shown in FIG. 4, in order to mount the connector housing 130 on the substrate 150, the ends of the compliant portions 121 of each of the contacts 120 are aligned with the respective plated through-holes 151 in the substrate 150. Then, the mounting tool 110 is fit into the connector housing 130 and portions of the bottom wall 113*b* of the engagement portion 112 surrounding the recesses 113*a* are engaged with the upper surfaces 122*c*. A downward force in the direction A is applied to the mounting tool 110, and this force is transmitted directly to the contacts 120 via the engagement of the ribs 113*d* on the bottom wall 113*b* with the upper surfaces 122*c* of the contacts 120. The application of the downward force causes the compliant portion 121 of the contacts 120 to be pressed into the plated through-holes 151 in the substrate 150 so as to provide a solderless mounting of the contacts 120 of the connector housing 130 to the substrate 150.

The application of the downward force of the mounting tool 110 directly to the contacts 120 enables a reliable solderless mounting of a connector to a substrate, reduces stress arising from thermal loading on the connector during use, and increases the positional tolerance of the connector.

In addition, each of the mounting tools 10, 110 is configured so as not to extend a significant distance outwardly from the perimeter of the respective connector housing 30, 130 during mounting of the respective connector housing 30 and 130, such that the mounting tools 10, 110 do not interfere with components and hardware disposed in the vicinity of the respective connector housing 30, 130 being mounted.

With the unique combination of mounting tools 10, 110, connector housings 30, 130, and contacts 20, 120, the row to row plastic included in the connector housing 30, 130 can be decreased by approximately 4%, i.e., reducing a pitch of 0.044" to 0.042". In addition, the compliant pin portion 21, 121 of each of the contacts 20, 120 can be reduced to approximately 77% of a typical 0.062" substrate thickness and such that the compliant pin portion 21, 121 of each of the contacts 20, 120 occupies approximate ½ of the barrel volume, which is defined as the volume of air created by the plated through-holes 51, 151 in the substrate 50, 150 into which the compliant pin portion 21, 121 is pressed. Thus, the geometries of the mounting tools 10, 110, connector housings 30, 130, and the contacts 20, 120 are significantly reduced in size while still producing adequate retention forces, i.e., preferably greater than 1 lb., of the connector housings 30, 130 to the substrates 50, 150, so as to prevent buckling of the contacts 20, 120.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A compliant pin connector mounting system comprising:

a connector housing;

a plurality of contacts each disposed in the connector housing and each including;

a compliant portion;

an intermediate portion extending from the compliant portion;

a beam portion extending from the intermediate portion; and two load bearing surfaces disposed on opposite sides of the beam portion and defined by upper surfaces of the intermediate portion; and a mounting tool arranged to fit into the connector housing and to contact the two load bearing surfaces of each of the plurality of contacts so as to apply a downward force directly to each of the plurality of contacts; wherein the compliant portion of each of the plurality of contacts is arranged to be aligned with a respective hole in a substrate such that when the downward force is applied directly to the two load bearing surfaces of each of plurality of contacts by the mounting tool, the compliant portion of each of the plurality of contacts is press fit into the respective hole in the substrate;

wherein a thickness of the intermediate portion is about 33% greater than a thickness of the beam portion.

2. The compliant pin connector mounting system according to claim 1, wherein the compliant portion of each of the plurality of contacts includes a hole extending therethrough.

3. The compliant pin connector mounting system according to claim 1, wherein the mounting tool includes a main body portion and an engagement portion extending from the main body portion; and the engagement portion is configured to fit into the connector housing and to be engaged with the two load bearing surfaces of each of the plurality of contacts.

4. The compliant pin connector mounting system according to claim 3, wherein the plurality of contacts are arranged in a plurality of rows in the connector housing; and the engagement portion includes a plurality of rows extending parallel or substantially parallel to one another and arranged so as to be interdigitated with the plurality of rows of the connector housing.

5. The compliant pin connector mounting system according to claim 4, wherein each of the plurality of rows of the engagement portion includes a bottom wall and recesses each arranged to receive a portion of a respective one of the plurality of contacts.

6. The compliant pin connector mounting system according to claim 5, wherein each of the recesses of the plurality of rows of the engagement portion extends longitudinally from the bottom wall of the engagement portion to the main body portion.

7. The compliant pin connector mounting system according to claim 5, wherein each of the recesses of the plurality of rows of the engagement portion has a width configured to receive a portion of a respective one of the plurality of contacts while portions of the bottom wall are engaged with the two load bearing surfaces of the respective one of the plurality of contacts when the mounting tool is engaged with the connector housing.

8. A method of mounting a compliant pin connector on a substrate, the method comprising the steps of:

providing a connector housing;

providing a plurality of contacts in the connector housing, each of the plurality of contacts including:

a compliant portion;

an intermediate portion extending from the compliant portion;

a beam portion extending from the intermediate portion; and two load bearing surfaces disposed on opposite sides of the beam portion and defined by upper surfaces of the intermediate portion; and aligning the compliant portion of each of the plurality of contacts with a respective hole in the substrate;

fitting a mounting tool into the connector housing so as to contact the two load bearing surfaces of each of the plurality of contacts; and applying a downward force directly to the load bearing surfaces of each of the plurality of contacts until the compliant portion of each of the plurality of contacts is press fit into the respective hole in the substrate;

wherein a thickness of the intermediate portion is about 33% greater than a thickness of the beam portion.

9. The method according to claim 8, wherein the compliant portion of each of the plurality of contacts includes a hole extending therethrough.

10. The method according to claim 8, wherein the mounting tool includes a main body portion and an engagement portion extending from the main body portion; the engagement portion is configured to fit into the connector housing and to be engaged with the two load bearing surfaces of each of the plurality of contacts.

11. The method according to claim 10, wherein the plurality of contacts are arranged in a plurality of rows in the connector housing; and the engagement portion includes a plurality of rows extending parallel or substantially parallel to one another and arranged so as to be interdigitated with the plurality of rows of the connector housing.

12. The method according to claim 11, wherein each of the plurality of rows of the engagement portion includes a bottom wall and recesses each arranged to receive a portion of a respective one of the plurality of contacts.

13. The method according to claim 12, wherein each of the recesses of the plurality of rows of the engagement portion extend longitudinally from the bottom wall of the engagement portion to the main body portion.

14. The method according to claim 12, wherein each of the recesses of the plurality of rows of the engagement portion has a width configured so as to receive a portion of a respective one of the plurality of contacts while portions of the bottom wall are engaged with the two load bearing surfaces of the respective one of the plurality of contacts when the mounting tool is engaged with the connector housing.

* * * * *